United States Patent [19]

Vandini

[11] Patent Number: 4,956,957

[45] Date of Patent: Sep. 18, 1990

[54] DEVICE FOR ASSOCIATING A PAIR OF PLANAR PARALLEL PANELS

[75] Inventor: Aldo Vandini, Bologna, Italy

[73] Assignee: Koaladesign S.r.L., Italy

[21] Appl. No.: 258,527

[22] Filed: Oct. 17, 1988

[51] Int. Cl.[5] ..... E04C 1/10

[52] U.S. Cl. ..... 52/584; 52/582

[58] Field of Search ..... 52/582, 584, 648; 403/406.1, 6, 231

[56] References Cited

U.S. PATENT DOCUMENTS

| | | | |
|---|---|---|---|
| 3,363,383 | 1/1968 | La Barge | 52/584 X |
| 3,516,215 | 6/1970 | Smith et al. | 52/584 X |
| 3,685,242 | 8/1972 | Safrata et al. | 52/884 X |
| 4,646,497 | 3/1987 | Hoenle | 52/582 X |

*Primary Examiner*—David A. Scherbel
*Assistant Examiner*—Creighton Smith

[57] ABSTRACT

Device for associating a pair of planar parallel panels, particularly for producing walls for exhibition stands and the like, includes a pair of L-shaped profiled elements arranged side by side and adapted to be respectively applied at the corners of corresponding panels, spacer means adapted to mutually associate the profiled elements, tension elements rigidly associated with the spacer means and adapted to rigidly associate the device with a similar device applied in a position which is angularly opposite to the pair of panels.

5 Claims, 2 Drawing Sheets

DEVICE FOR ASSOCIATING A PAIR OF PLANAR PARALLEL PANELS

BACKGROUND OF THE INVENTION

The present invention relates to a device for associating a pair of planar parallel panels of any thickness, particularly to provide walls for exhibition stands and the like.

As is known, in the above specified field there is generally the need to divide the exhibition area by means of dividing walls made of panels which can also be used as support for drawings, posters and the like. Such panels must be suitable to form walls of different dimensions and geometries according to the requirements of the exhibition. Furthermore, in order to reduce setup costs, it is obviously necessary that said panels be easy and rapid to assemble and disassemble. The systems currently in use to provide said diving walls do not entirely meet these requirements.

SUMMARY OF THE INVENTION

The aim of the present invention is to provide a device for associating in a simple and rapid manner pairs of planar parallel panels so as to make walls of any type of configuration.

Within this aim, an object of the present invention is to provide a device which is simple in concept, easy, reliable and versatile in use and relatively economical in its cost.

This aim and this object are both achieved, according to the invention, by a device for associating a pair of planar parallel panels, particularly to provide walls for exhibition stands and the like, comprising a pair of profiled elements and a spacer block arranged between said profiled elements and connected therewith, each profiled element comprising a plate having a right angle and an outer edge extending along two sides of said plate enclosing said right angle, said plate and edge defining a groove into which a corner of said panels engages, said spacer block including a seat and a sylinder being rotatably accommodated in said seat according to an axis perpendicular to said plates, said cylinder being provided with means for anchoring one end of a tensioning member extending between said pair of panels and having the opposite end associated to a similar device applied in diagonally opposite corners of said panels.

BRIEF DESCRIPTION OF THE DRAWINGS

The details of the invention will become apparent from the detailed description of a preferred embodiment of the device for mutually associating a pair of planar parallel panels, illustrated by way of non-limitative example in the accompanying drawing, wherein.

DESCRIPTION OF THE PREFERRED EMBODIMENTS

Figure 2:
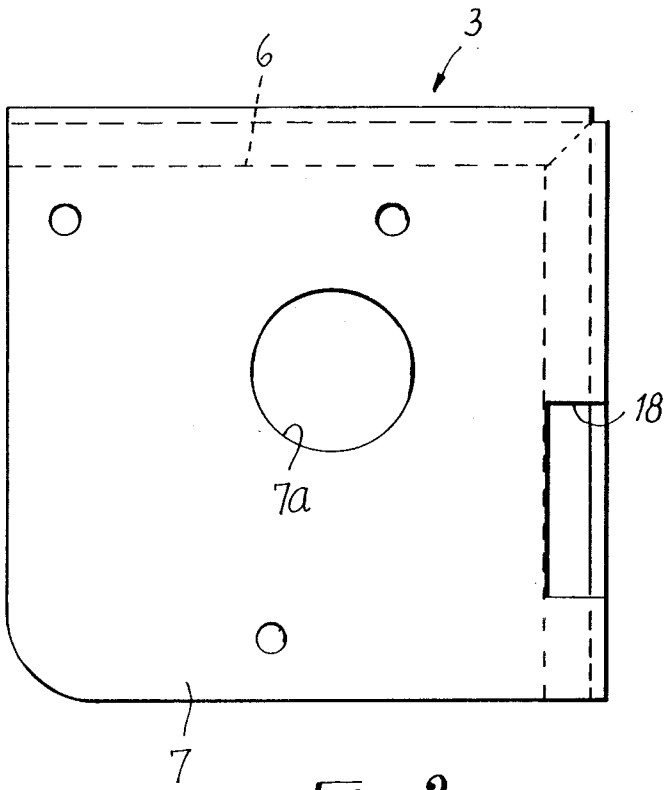
FIG. 2 is a side view of the device taken on the plane II—II of FIG. 4.
Figure 1:
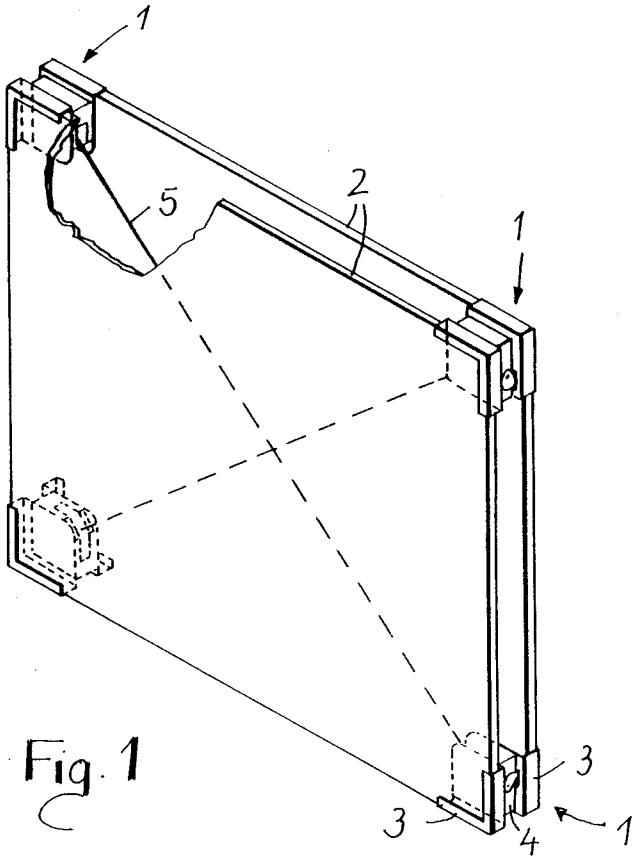
FIG. 1 is a perspective view of a pair of panels associated by means of the device according to the invention.

With reference to the above described figures, the numeral 1 generally indicates the device intended, according to the invention, to mutually associate a pair of planar parallel panels 2 to form a wall.

The device 1 comprises a pair of profiled elements 3 adapted to be respectively applied at the corners of the panels 2 and mutually associated by means of a spacer block 4. The spacer block 4 is associated to a tension member 5, adapted to rigidly couple the device 1 with a similar device applied in an diagonally opposite position of the panels 2.

More in detail, each profiled element 3 has a sort of groove 3*a* which is defined between an edge 6, on the outer side of the device, and a plate 7 on the inner side. The plate 7, has a rectangular form and the edge 6 extends along two sides of the plate to define L-shaped grooves 3*a*.

The spacer block 4 is constituted by a body having a significantly flattened parallelepipedal shape and is fixed, by means of a plurality of rivets 8, between the profiled elements 3, so as to set their mutual distance. The spacer block 4 is centrally provided with a seat 4*a* housing a cylinder 9 the axis whereof is perpendicular to the walls plates 7 of the profiled elements 3. The tension member 5 has a terminal portion 10 inserted diametrally in the cylinder 9 and can be moved axially by means of a screw element 11 to tension said tension element. A dowel 12 acts on a flattened portion 10*a* of the terminal 10 in order to prevent its rotation when the screw 11 is screwed. The dowel 12 is accessible through a central opening 7*a* in the walls 7.

The tension member 5 protrudes diagonally from the device 1 through a cavity 13 provided on the middle plane of the spacer block 4. The screw 11 is actuatable by means of an appropriate tool through a further cavity 14 which is diametrally opposite to the preceding one with respect to the cylinder 9.

The spacer block 4 furthermore has means for locking the panels 2 within grooves 3*a* of the profiled elements 3. Said locking means, which have the purpose of compensating different thicknesses of the panels with respect to the width of the grooves 3*a*, are substantially constituted by a pair of mutually superimposed plates 15, 16 coaxially rotatable in opposite directions about a pivot 17. The plates 15, 16 have a symmetrically trapezoidal shape so to press, at one end, respectively on one of the panels 2 through an opening 18 provided in the wall of the profiled elements 3. The angular rotation of the plates 15, 16 is determined by the translatory motion of a shank 19 which slideably engages respective mutually oblique elongated slots 20, 21 of said plates. The shank 19 has a portion provided with a female thread 22 which is coupled to a threaded stem 23 and is movable within a seat 24 provided in the spacer block 4. The stem 23 is provided, at one end, with a diametral notch 25, accessible through the cavity 14, for the engagement of an appropriate tool.

Figure 4:
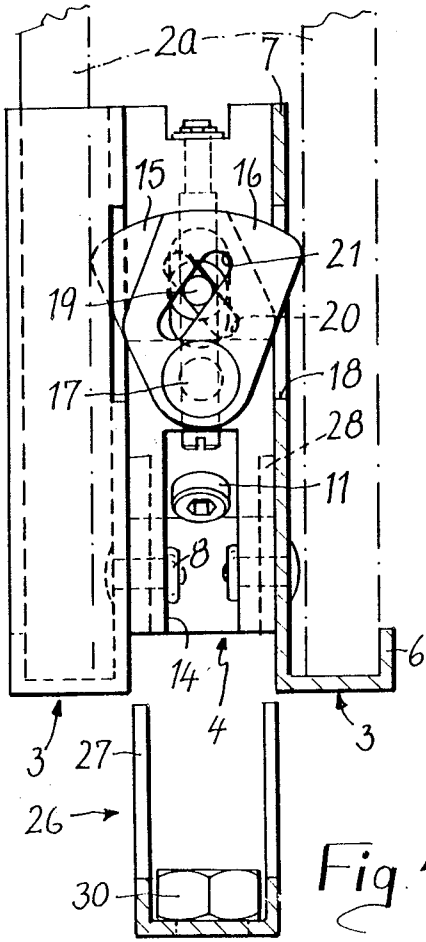
FIG. 4 is a sectional view of the device taken on the plane IV—IV of FIG. 3.

Thus, by rotating the stem 23 the shank 19 can be displaced along the seat 24 and the plates 15, 16 owing to the oblique slots 20, 21 are caused to rotate in opposite directions thus pressing the panels 2 against the outer edge 6 of the profiled elements 3, as indicated in broken lines 2*a* in FIG. 4.

Each pair of planar parallel panels 2 is thus positioned at its corners by means of respective devices 1 and rigidly associated by means of a pair of crossed tension members 5 which thus clamp, when tensioned, the pair of panels with a compressed action in a diagonal direction.

Figure 3:
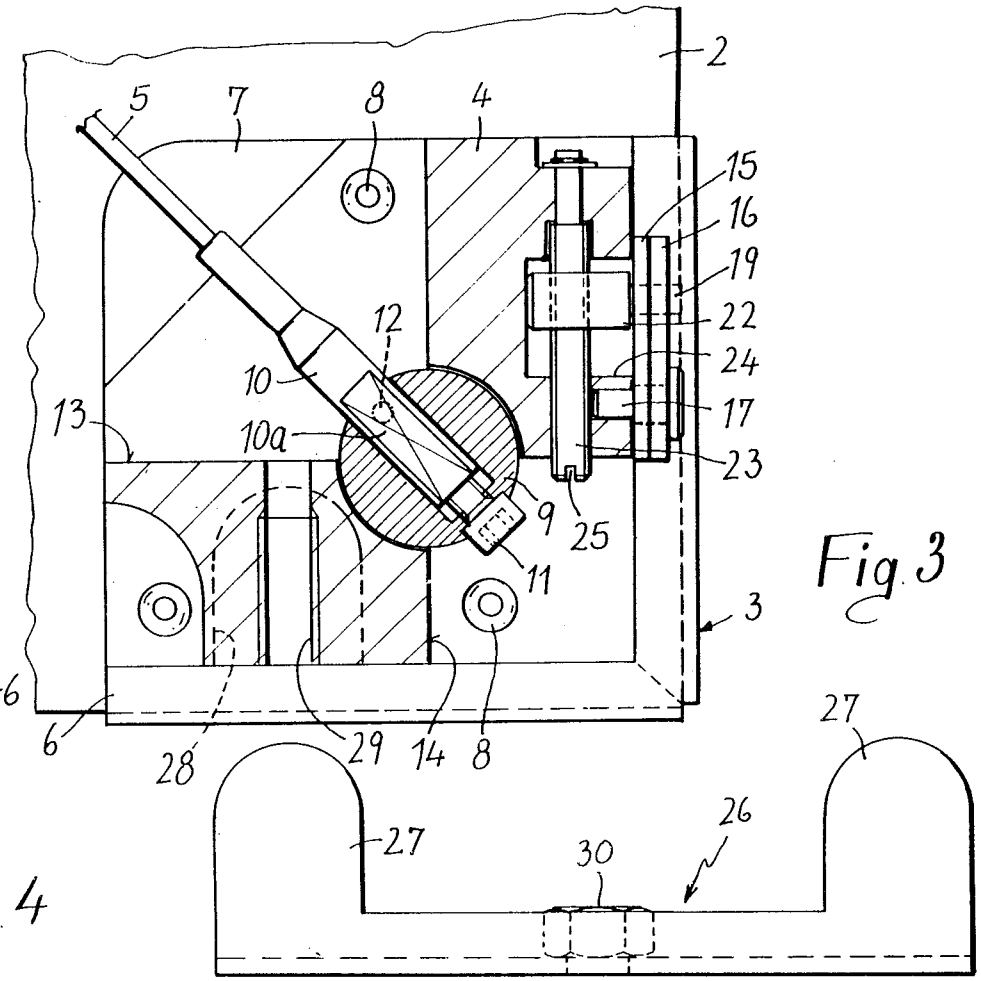
FIG. 3 is sectional view of the device, taken on the plane III—III of FIG. 4 and illustrating in spaced position means for coupling a pair of adjacent walls.

Said pair of panels is intended to be connected, in order to form a dividing wall, to similar pairs of panels by means of coupling means such as that indicated by the reference numeral 26 in FIGS. 3 and 4.

The coupling means 26 comprises a profiled element having a U-shaped cross section which has, at its opposite ends, respective wings 27 which extend from its longitudinal edges. The wings 27 are adapted to insert within corresponding recesses 28 provided in the spacer block 4 adjacent to the plates 7.

The profiled element illustrated in the drawing is obviously adapted for coupling two pairs of horizontally flanking and co-planar panels, its wings 27 inserting in the spacer blocks 4 of respective adjacent devices 1. Corner-shaped and cross-shaped simple or double profiled elements, equally having said pair of wings at the ends of their related arms, are however also provided for the horizontal and vertical coupling of the panels according to different geometries.

A connecting profiled element is furthermore provided, constituted by a single pair of wings and having, for its coupling to a pair of vertically adjacent panels, a hole for the passage of screw means which screw in a threaded hole 29 provided in the body of the spacer 4. The mounting of appropriate feet is provided at the base of the dividing wall, said feet screwing, according to the instances, in nuts 30 arranged at holes provided centrally to said profiled elements or in the threaded hole 29 provided in the spacer block 4.

In the practical embodiment of the invention, the materials employed, as well as the shapes and dimensions, may be any according to the requirements.

I claim:

1. Device for associating a pair of planar parallel panels particularly to provide walls for exhibition stands and the like, comprising a pair of profiled elements and a spacer block arranged between said profiled elements and connected therewith, each profiled element comprising a plate having a right angle and an outer edge extending along two sides of said plate enclosing said right angle, said plate and edge defining a groove into which a corner of said panels engages, said spacer block including a seat and a sylinder being rotatably accommodated in said seat according to an axis perpendicular to said plates, said cylinder being provided with means for anchoring one end of a tensioning member extending between said pair of panels and having the opposite end associated to a similar device applied in diagonally opposite corners of said panels.

2. Device according to claim 1 wherein said anchoring means comprises a terminal portion provided at one end of said tensioning member and diametrically inserted in said cylinder and a screw axially engaging said terminal member and abutting said cylinder.

3. Device according to claim 1 further comprising a pair of adjacent symmetric plates rotatably supported on said spacer block and adapted to oscillate perpendicularly to said profiled elements, and means for oscillating said plates in opposite directions to cause said plates to engage said panels through openings formed in said profiled elements and to press said panels against said outer edges.

4. Device according to claim 3, wherein said oscillating means comprises elongated slots formed in said plates, a seat formed in said spacer block and facing said plates, a shank engaging said slots and having a portion guided in said seat and provided with a female thread, and a threaded stem engaging said female thread, rotation of said stem causing displacement of said shank along said seat, said elongated slots being obliquely arranged to cause said plates to oscillate in opposite directions.

5. Device according to claim 1 wherein means for coupling adjacent walls are provided, said means comprising an element having longitudinal edges defining a U-shaped cross section and wings extending from said longitudinal edges at the opposite ends thereof, said spaces block being provided with recesses adapted to receive said wings and with threaded holes into which screw means are screwed for securing said element to said spacer block, on said element being centrally arranged a nut for engagement of an appropriate wall supporting foot.

* * * * *